United States Patent [19]

Ricci

[11] 4,327,686

[45] May 4, 1982

[54] IGNITION ADVANCE CORRECTION DEVICE

[75] Inventor: Jean C. Ricci, Bezons, France

[73] Assignee: Ducellier & Cie, France

[21] Appl. No.: 165,677

[22] Filed: Jul. 3, 1980

Related U.S. Application Data

[63] Continuation of Ser. No. 951,627, Oct. 16, 1978, abandoned.

[30] Foreign Application Priority Data

Oct. 20, 1977 [FR] France ..... 77 31546

[51] Int. Cl.[3] ..... F02D 33/00; F02P 5/12; F02P 5/04

[52] U.S. Cl. ..... 123/408; 123/407; 123/146.5 A

[58] Field of Search ..... 123/146.5 A, 407, 408

[56] References Cited

U.S. PATENT DOCUMENTS

| | | | |
|---|---|---|---|
| 2,698,010 | 12/1954 | Hartman, Jr. et al. | 123/407 |
| 2,769,436 | 11/1956 | Sterner | 123/407 |
| 3,547,088 | 12/1970 | Yagi | 123/146.5 A |
| 3,885,535 | 5/1975 | Walker | 123/407 |
| 3,911,880 | 10/1975 | Gnepp | 123/408 |
| 3,939,810 | 2/1976 | Walker | 123/408 |
| 3,960,125 | 6/1976 | Mattson | 123/408 |
| 4,112,891 | 9/1978 | Spaulding | 123/146.5 A |
| 4,129,104 | 12/1978 | Kawakami | 123/408 |
| 4,135,480 | 1/1979 | Marsee | 123/408 |
| 4,151,818 | 5/1979 | Tateno | 123/408 |

FOREIGN PATENT DOCUMENTS

| | | | |
|---|---|---|---|
| 2244456 | 4/1973 | Fed. Rep. of Germany | 123/408 |
| 2459107 | 6/1975 | Fed. Rep. of Germany | 123/408 |
| 2402083 | 4/1979 | France | 123/408 |

*Primary Examiner*—Raymond A. Nelli

[57] ABSTRACT

An engine ignition advance correction device in which a distributor co-acts with two independent capsules sensitive respectively to variations in pressure at different locations in the engine, the capsules acting on an advance lever pivoted on a fixed part of the distributor and carrying a pair of pivotally mounted advance levers, the capsules acting on the advance lever either successively to provide ignition advance when the depression is sufficient at only one of said locations, or simultaneously to provide ignition advance corresponding to the sum of the maximum advance values effected respectively by the capsules.

9 Claims, 8 Drawing Figures

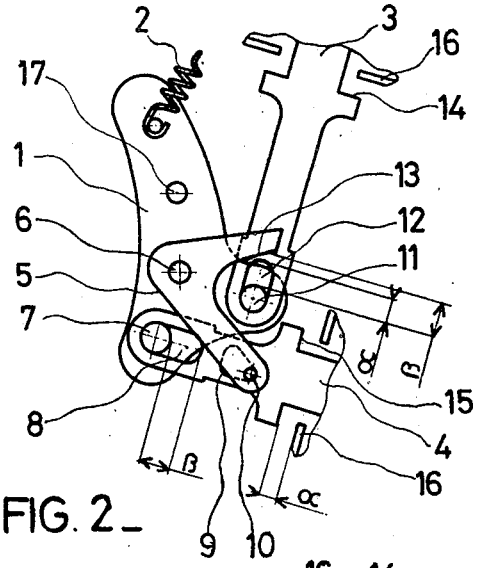
_FIG. 2_
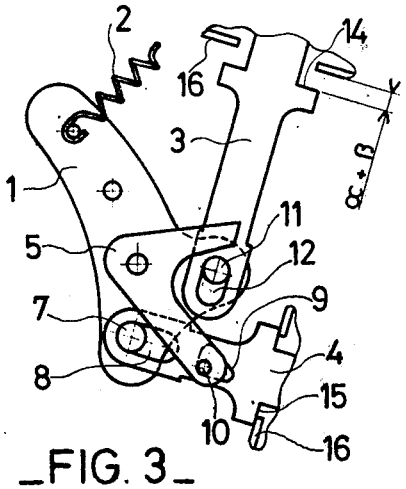
_FIG. 3_
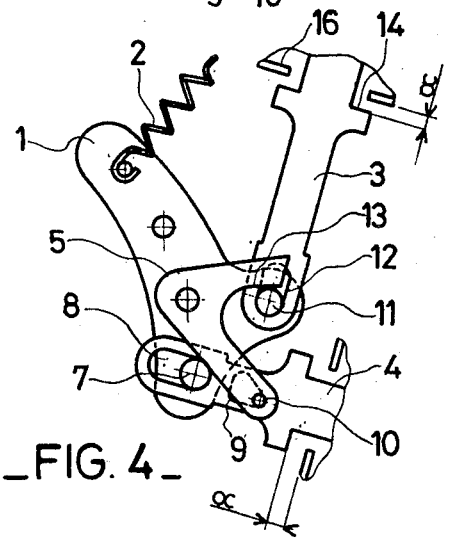
_FIG. 4_
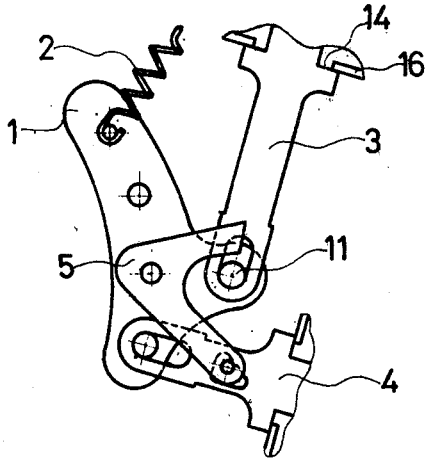
_FIG. 5_
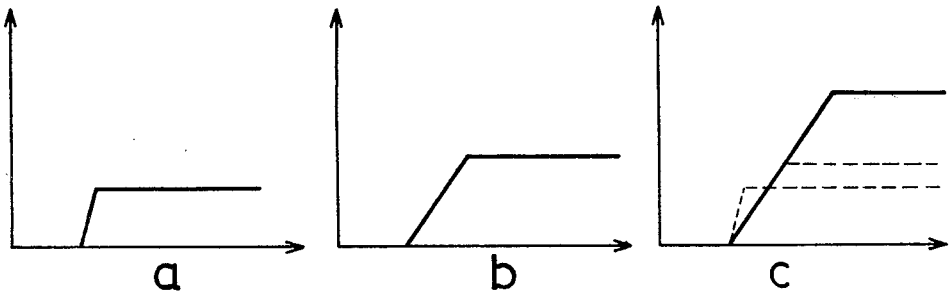
_FIG. 6_

IGNITION ADVANCE CORRECTION DEVICE

This is a continuation, of application Ser. No. 951,627, filed Oct. 16, 1978 now abandoned.

The present invention concerns an ignition advance correction device for a motor vehicle internal combustion engine, and including a distributor of the kind having an arm pivotally mounted about a shaft rigid with an advance lever and acting upon by two capsules sensitive to variations in pressure, the lever being rotatable about a pivot rigid with a fixed plate in the distributor housing.

Devices are known which have two capsules sensitive to depression, one of which provides ignition advance and the other ignition retard. However, for certain vehicles and with the main aim of fuel economy, it may be necessary for both the capsules to provide ignition advance as a function of the depression prevailing at two separate locations in the engine, and it is an object of the present invention to provide an ignition advance correction device capable of providing this facility.

According to the invention, an ignition advance correction device for a motor vehicle internal combustion engine comprises an ignition distributor having at least one contact breaker arm pivotally mounted about a shaft rigid with an advance lever subject to the action of two capsules acting independently of one another and sensitive to variations in pressure at different locations in the engine said lever being rotatable about a pivot rigid with a fixed plate in the distributor housing, the capsules being arranged to act on the advance lever either successively so that each is able to provide a maximum defined value of ignition advance when the depression is sufficient at only one of said locations, or simultaneously so as to provide a maximum ignition advance corresponding to the sum of the two maximum ignition advances which can be effected respectively by the capsules, when the depression is sufficient at both of said locations.

Figure 1:
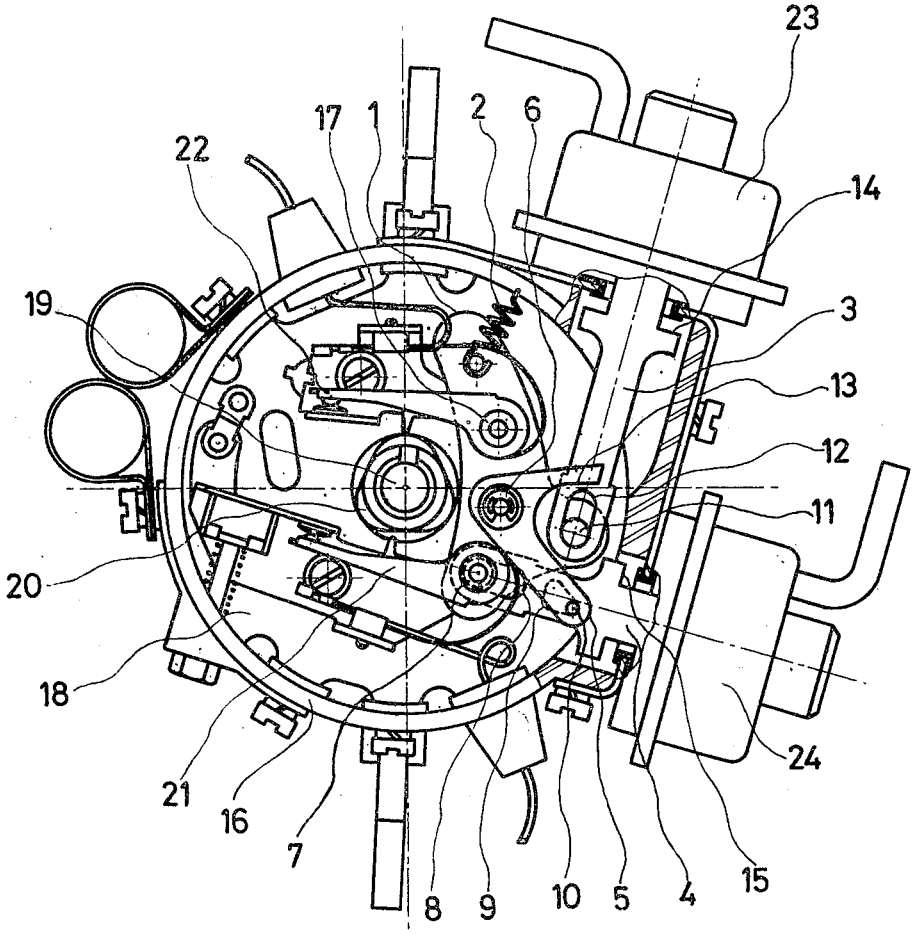
Figure 7:
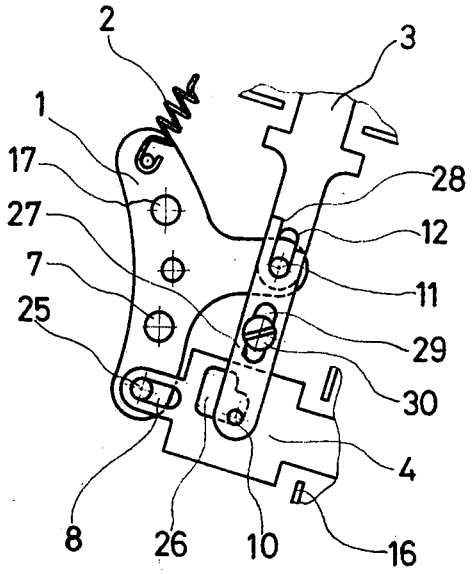
Figure 8:
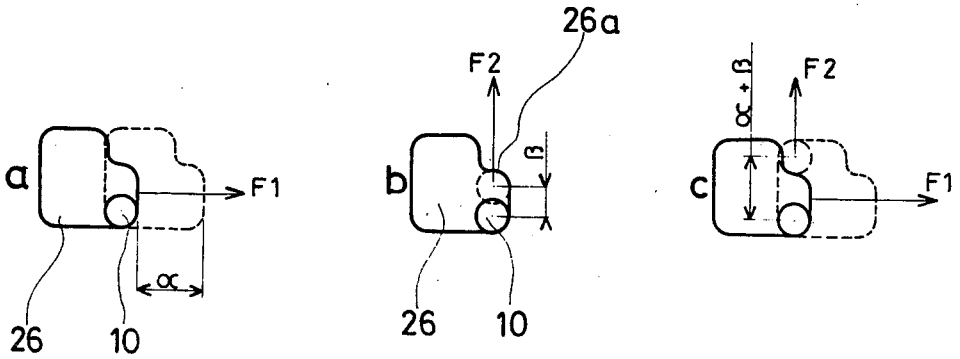

The invention will now be described, by way of example with reference to the accompanying drawings in which:

FIG. 1 is a plan view of the ignition device of the invention,

FIG. 2 shows in plan the removal contact breaker arm-carrying lever and the various elements which act upon it, FIG. 3 shows in plan the same elements as FIG. 2 when one of the capsules is operative, FIG. 4 shows in plan the same elements as FIG. 2 when the other capsule is operative, FIG. 5 shows in plan the same elements as FIG. 2 during simultaneous operation of the two capsules, FIGS. 6*a*–6*c* show the advance curves obtained as a result of the operation of the capsules, FIG. 7 is a plan view of another embodiment of the advance correction device of the invention, and FIG. 8 shows schematically a kinematic representation at the level of the slot and pin of the embodiment of FIG. 7.

Referring to FIGS. 1 to 5, the ignition advance correction device of the invention includes a housing 16 in which turns a shaft 19 rotatably driving a cam 20, which controls the opening and closing of two contact breakers by means of contact breaker arms 21 and 22. The arms 21 and 22 pivot about shafts 7 and 17 rigid with a lever 1, which is articulated about a shaft 6 rigid with a plate 18 and is driven in rotation by the movable mechanism of movable depression sensitive capsules 23 and 24 via rods 3 and 4 acting against a return spring 2.

The two capsules move the lever 1 in the same direction, providing ignition advance; and for this the rod 3 of the capsule 23 has a slot 12 which acts to drive the lever 1 by means of a drive pin 11 also to leave a certain free clearance for the pin 11 when the rod 4 alone drives the lever 1 by a drive pin 7 rigid with the lever 1 and housed in a slot 8 in the rod 4. Similarly, this slot 8 allows a certain clearance for the pin 7 under the action of the rod 3.

The rods 3 and 4 have abutments, respectively 14 and 15, which limit the movement of the rods 3 and 4 when they come into contact against the housing 16. A blocking lever 5, freely rotatably mounted on the rotational shaft 6 of the lever 1, has a pin 10 which limits the clearance of the blocking lever 5, by its movement within a slot 9, of suitable shape, formed in the rod 4. Moreover, this blocking lever 5 has a curved portion, of which the internal face 13 also acts as an abutment against the pin 11 of the lever 1.

The operation of the above-described device is as follows:

In the rest position (see FIG. 2) the capsules 23 and 24 are not acted upon by the depression and the rods 3 and 4 apply no traction forces to the lever 1, which is held back by the traction spring 2. The various elements are then in the following positions.

The pin 7 of the lever 1 is in abutment with one end of the slot 8 of the rod 4. The pin 11 of the lever 1 is in abutment with one end of the slot 12 of the rod 3. The pin 10 of the blocking lever 5 is disposed in the slot 10 of the rod 4 preferably in abutment against the face of the slot located towards the capsule 24. When thus disposed in the rest position, the various elements have angular relationships corresponding to the various angular displacements necessary for the better performance of an engine equipped with the device of the invention.

In fact, the divergence between the abutment 15 and the housing 16 corresponds to the movement of the rod 4 necessary to give an angular displacement through an angle $\alpha$. This angle $\alpha$ is also limited by the minimum clearance of the pin 11 of the lever 11 in the slot 12 of the lever 3. The angle $\beta$ is limited by the minimum clearance of the pin 7 of the lever 1 in the slot 8 of the rod 4, and is again exactly between the pin 11 of the lever 1 and the abutment 13 of the blocking lever 5. The divergence between the abutment 14 of the rod 3 and the housing 16 corresponds to the necessary displacement of the rod 3 to cause the lever 1 to pivot through an angle corresponding to the sum $\alpha+\beta$. The dimensions of the slot 9 of the rod 4 are a function of the values of the angles $\alpha$ and $\beta$.

When the depression corresponding to the capsule 24 alone is sufficient, the rod 4 moves until the abutment 15 comes into contact against the housing 16 (see FIG. 3). During this movement, the rod 3 has remained immobile, the pin 7 of the lever 1 is pulled by the slot 8 of the rod 4, and the pin 11 of the lever 1 moves in the slot 12 of the rod 3 until it is in its extreme position in the slot 12. The blocking lever 5 has remained free, and thus its pin 10 has come substantially longitudinally closer to another face of the slot 9 of the rod 4.

The maximum rotation of the lever 1 thus obtained by the traction of the rod 4 on the pin 7, causes an angular displacement of the point of ignition which is equivalent to the value $\alpha$ and of which the shape of the ignition advance correction curve obtained is shown in FIG. 6*a*. When this depression again becomes insufficient, the device returns to the rest position previously defined, under the action of the return spring 2. When only the depression corresponding to the capsule 23 is sufficient, the rod 3 moves, driving with it the lever 1 by means of the pin 11 and the slot 12 (see FIG. 4). In fact, the slot 12 pulls the pin 11 until it comes into abutment against the face 13 of the blocking lever 5, which is itself in fixed position defined by the abutment between its pin 10 and the slot 9 of the rod 4. The pin 7 of the lever 1 is thus moved in the slot 8 of the rod 4. However, the abutment 14 is not yet in contact with the housing 16.

Thus the lever 1 has effected a rotation which causes the maximum displacement $\beta$ of the point of ignition when the second depression in question has become active and of which the shape of the ignition advance correction curve obtained is shown in FIG. 6*b*. When this depression disappears, the device then returns to its rest position (see FIG. 2) under the action of the return spring 2.

In the case where the two depressions in question are sufficient to ensure the movement of the rods 3 and 4, the rod 3 pulls on the pin 11 of the lever 1 and the rod 4 moves simultaneously, freeing the blocking lever 5 and thus unlocking it, which allows greater movement of the rod 3 until the abutment 14 comes into contact against the housing 16. In this case, the capsule 24 is used only for unlocking the blocking lever 5. There is then a maximum rotation of the lever 1 which corresponds to the displacement $\alpha+\beta$ of the point of ignition, of which the shape of the ignition advance correction curve obtained is shown by the curve 6*c*.

FIG. 7 shows a second embodiment of the invention, differing essentially from the preceding one by: the shape of the blocking lever 27 which is in fact an extension of the rod 3; by the fact that the rod 4 is connected to the lever 1, carrying contact breaker arms, by another pin 25 which is not the articulation shaft 7 of the arm 21; and as a result by the shape of the slot 26 formed in the rod 4 and in which moves the pin 10 rigid with the blocking lever 27; and by the fact that the extension 27 and the rod 3 are rigidly connected by means for adjusting the useful length of the extension 27, which adjustment means are constituted, on the on hand by a screw 30 which passes through a slot 29 in the extension 27 and screws into a threaded hole in the rod 3, and on the other hand by a fork 28 which acts to guide the pin 11.

The said slot 26 essentially comprises three operational dimensions; in the longitudinal direction of the rod 4 a length corresponding to the displacement of the said rod 4 to cause the lever 1 to swing through an angle $\alpha$; perpendicularly and towards the capsule 24, a length corresponding to the displacement of the rod 3 to cause the lever 1 to swing through an angle $\beta$; perpendicularly and towards the lever 1, a length corresponding to the rod 3 to cause the lever 1 to swing through an angle $\alpha+\beta$.

The operation of such an embodiment is thus as follows:

Action of the capsule 24 alone: from which results rotation of the lever 1 through an angle $\alpha$. The rod 4 moves in the direction of the arrow 1 of FIG. 8*a* and causes the lever 1 to pivot; the pin 11 of said lever 1 moves in the slot 12 of the rod 3 until the slot 26 of the rod 4 comes into abutment against the pin 10 of the extension 27 as shown in broken lines in FIG. 8*a*.

Action of the capsule 23 alone: from which results rotation of the lever 1 through an angle $\beta$. The rod 3 moves in the direction of the arrow F2 (FIG. 8*b*) and acts upon the pin 11 of the lever 1; the pin 25 moves in the slot 8, and the pin 10 moves until it comes into abutment against the face 26*a* of the slot 26 as shown in broken lines in FIG. 8*b*.

Simultaneous action of the two capsules; the rod 3 moves in the direction of the arrow F2 and the rod 4 moves in the direction of the arrow F1. As a result the pin 10 and the slot 26 move until they come into abutment, as shown in broken lines in FIG. 8*c*, the angle of rotation of the lever 1 being, in this case, the sum of the angles $\alpha$ and $\beta$, previously effected for each capsule acting alone.

In this second embodiment, the extension 27 may clearly be the end of the rod 3 itself.

By means of the devices of the invention, greater precision and finer adjustment of the point of ignition depending upon the different loads on the engine are obtained. Moreover, since both the capsules effect ignition advance, it is easy to obtain any required shape of ignition advance correction curve, which may have different slopes depending upon the characteristics of each capsule and the order in which they become active.

It is understood that modifications may be made to such a device without going beyond the scope of the invention. In fact, this device may be applied to ignition with one or two contact breakers and the rods 3 and 4 may be differently oriented depending upon the stresses to be applied to them.

I claim:

1. An ignition advance correction device for a motor vehicle internal combustion engine, comprising an ignition distributor which has at least one contact breaker arm, a fixed support, an advance lever pivotally mounted on the fixed support and itself pivotally carrying said contact breaker arm, and first and second depression responsive devices connected to the advance lever and adapted to sense variations in pressure at different locations in the engine, a blocking means which includes a connecting means coupling said advance lever to said first depression responsive device and a control element coupling said advance lever to said second depression responsive device, said advance lever being moved in response to variations in pressure sensed by each of said devices, and a blocking element connected to said fixed support and releasably coupled to said first depression responsive device, said blocking element being spaced a predetermined distance from said control element and adapted to contact said control element when said second depression responsive device has moved said predetermined distance, said blocking element being coupled to said first device to be released from said first device by action of said first device after said second device has moved said predetermined distance, whereby said advance lever is moved by each of said devices via said connecting means and said control element independently of the other device so that each device is able to provide a predetermined ignition advance in response to the depression prevailing at a respective one of said locations independently of a depression prevailing at the other device, said blocking element being coupled to said first device and said predetermined distance being selected such that, when not activated by depression, said first device acts via said blocking element to limit the amount of ignition advance which can be effected by said second device acting alone, but permits further ignition advance beyond said predetermined ignition advance by said second device during depression activation of said first device which releases said blocking element from said first device so that said second device acts on said advance lever independently of said first device during said further ignition advance.

2. A device according to claim 1, wherein the advance lever is connected via said connecting means and said control element respectively to movable mechanisms of the pair of depression responsive devices by means of two drive pins engaged in two longitudinal slots formed towards the free ends of connecting rods of the respective mechanisms, the arrangement being such that, in the rest position of the device each pin is against the base of its associated one of the slots and is able to move therein longitudinally along a length corresponding to the angular movement of the advance lever under the action of the depression responsive device in the rod of which the other slot is formed.

3. A device according to claim 2, wherein said blocking element includes a blocking lever which articulates about a shaft rigid with the fixed support and which is able to limit the travel of the movable mechanism of said second depression responsive device when said first pressure responsive device is not subject to sufficient depression.

4. A device according to claim 3, wherein the blocking lever has at one of its ends a pin which engages in a slot formed in the rod of the movable mechanism of said first pressure responsive device, the slot being arranged so as, on the one hand, to lock the blocking lever when said first pressure responsive device is not subject to sufficient depression and as a result to form an abutment against the movement of the pin of the advance lever acted upon by said second pressure responsive device, and on the other hand, to unlock the blocking lever when said first pressure responsive device is subject to sufficient depression and as a result to allow the complete movement of the rod of said second pressure responsive device.

5. A device according to claim 2, wherein an extension of the rod of the movable mechanism connected to said second pressure responsive device is connected to the rod of the movable mechanism connected to said first pressure responsive device in such a way that it limits the travel of the movable mechanism of said second pressure responsive device when said first pressure responsive device is not subject to sufficient depression.

6. A device according to claim 5, wherein the extension of the rod of said second pressure responsive device has a pin adapted to move in a slot formed in the other rod.

7. A device according to claim 5 or 6, wherein the extension of the rod of said second pressure responsive device is joined on to said second device rod.

8. A device according to claim 7, wherein the rod extension has means for adjusting its useful length.

9. A device according to claim 8, wherein the adjustment means is constituted by a screw which passes through a slot formed in the rod extension to screw into a threaded hole in the rod having the extension and by a fork which holds captive a pin of the contact breaker carrying arm which moves in the said rod.

* * * * *